US010495030B1

(12) United States Patent
Dudar et al.

(10) Patent No.: US 10,495,030 B1
(45) Date of Patent: Dec. 3, 2019

(54) EVAPORATIVE EMISSION CONTROL SYSTEM AND DIAGNOSTIC METHOD

(71) Applicant: Ford Global Technologies, LLC, Dearborn, MI (US)

(72) Inventors: Aed M. Dudar, Canton, MI (US); Mark Peters, Wolverine Lake, MI (US); Donald Ignasiak, Farmington Hills, MI (US); Deborah Dukatz, Canton, MI (US); John Hefferon, Madison Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 11 days.

(21) Appl. No.: 16/000,758

(22) Filed: Jun. 5, 2018

(51) Int. Cl.
*F02M 25/08* (2006.01)

(52) U.S. Cl.
CPC .... *F02M 25/0809* (2013.01); *F02M 25/0836* (2013.01); *F02M 25/0854* (2013.01)

(58) Field of Classification Search
CPC ..... F02M 25/08; F02M 25/0809; F02M 25/0836; F02M 25/0854
See application file for complete search history.

(56) References Cited

U.S. PATENT DOCUMENTS 5,054,455 A * 10/1991 Cook ..... F02D 41/004 123/516
5,226,398 A * 7/1993 Cook ..... F02M 25/0836 123/518
6,772,741 B1 8/2004 Pittel et al.
7,594,500 B2 * 9/2009 Rockwell ..... F02M 25/089 123/518
9,243,591 B2 1/2016 Jentz et al.
2017/0045007 A1 2/2017 Pursifull

* cited by examiner

*Primary Examiner* — Hieu T Vo
(74) *Attorney, Agent, or Firm* — Geoffrey Brumbaugh; McCoy Russell LLP

(57) ABSTRACT

A method for diagnosing an evaporative emission control system that includes during a first state of a vapor blocking valve, determining a first rate of change of a fuel tank vacuum, during a second state of the vapor blocking valve different from the first state, determining a second rate of change of the fuel tank vacuum, and diagnosing an operational condition of the vapor blocking valve based on the first and second rates of change.

20 Claims, 6 Drawing Sheets

FIG. 2
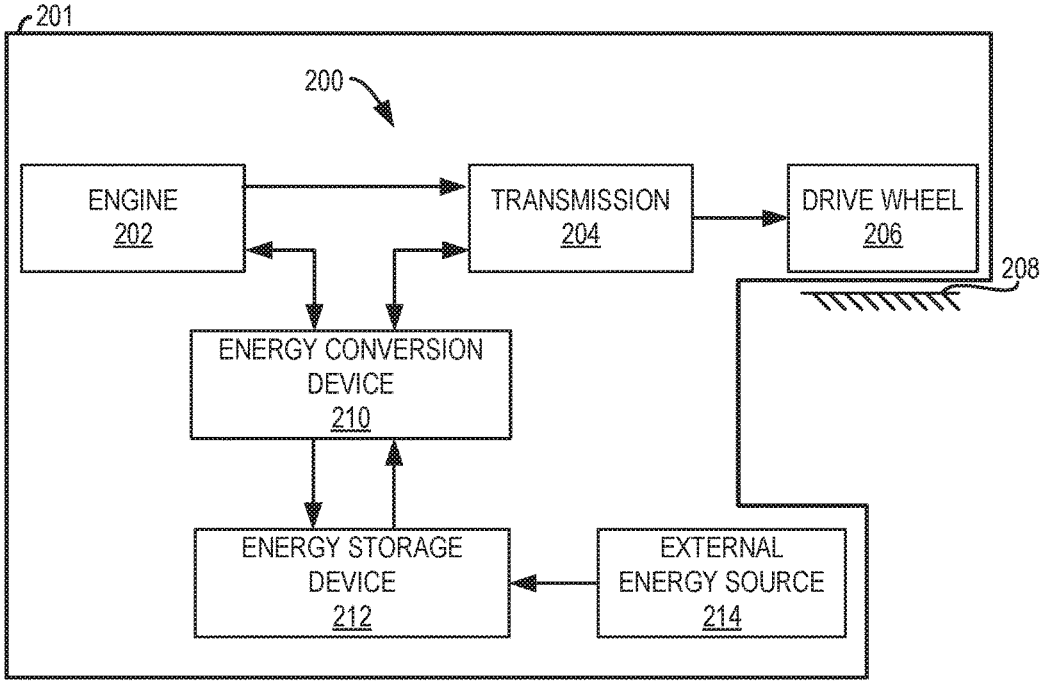
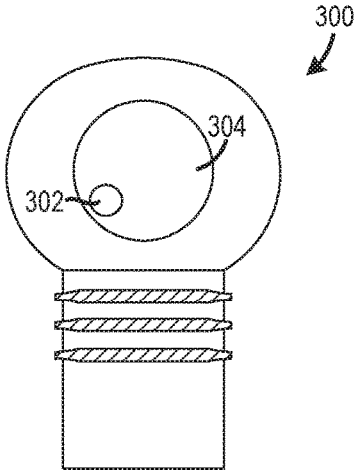
FIG. 3
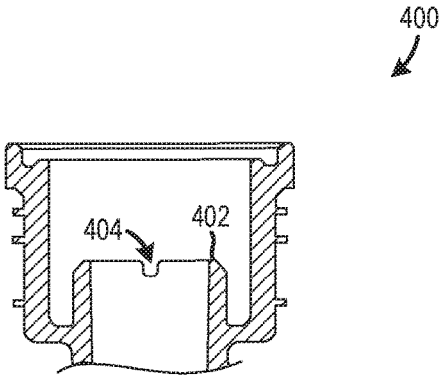
FIG. 4

EVAPORATIVE EMISSION CONTROL SYSTEM AND DIAGNOSTIC METHOD

FIELD

The present description relates generally to an evaporative emission control system and a diagnostic method for the evaporative emission control system.

BACKGROUND/SUMMARY

Vehicles have been designed to capture and store fuel vapors in carbon canisters to comply with emissions standards in a variety of markets. In some vehicles, such as vehicle's designed with stop-start capabilities, the engines may have limited run times and therefore may overload the carbon canister. For instance, during an idle-stop condition fuel stored in a fuel tank will continue to vaporize and load the canister. Overloaded canisters present a variety of problems, such as an inability to purge the canister by a desired amount due to scheduled drive cycle diagnostic routines that cannot be implemented in tandem with canister purge operation.

Attempts have been made to remedy this problem by installing a vapor blocking valve between the canister and the fuel tank. The vapor blocking valve may be closed to completely seal the fuel tank during conditions such as canister purge operation, a key-on condition, etc., and opened during other conditions. In this way, during idle-stop canister loading is prevented. However, completely sealing the fuel tank with the vapor blocking valve causes fuel tank pressure buildup. The pressure buildup in the fuel tank may necessitate a purge strategy that slowly ramps up vapor purge to avoid engine stalls caused by a fuel vapor spike (e.g., vapor slug) in the intake system. However, slowly ramping up vapor purge creates a purge efficiency penalty and therefore leaves a smaller window open to purge the canister during a drive cycle. As such, vapor blocking valves have been designed with notches to reduce the amount of fuel vapor buildup in the fuel tank. Consequently, more efficient vapor purging may be carried out while reducing canister loading during idle-stop.

However, previous diagnostic routines where a vacuum is generated in the fuel tank and threshold pressures are used to determine if a leak is occurring in the vapor recovery system are not applicable to systems employing notched vapor blocking valves due to the gas flow through the notch. For instance, U.S. Pat. No. 9,243,591 discloses a diagnostic technique for a vapor recovery system. In the diagnostic routine, a vacuum is generated in the fuel tank and during a subsequent a bleed-up phase the rate of bleed-up is compared against a threshold. However, this diagnostic technique is not compatible with a system having a notched vapor blocking valve because the notch will adversely affect the bleed-up rate. Furthermore, the bleed-up threshold disclosed in U.S. Pat. No. 9,243,591 is limited to the specific design of the vapor recovery system. As such, the threshold bleed-up rate may be separately calibrated for different engine designs, driving up costs and creating barriers that may limit the system's applicability.

To address at least some of the aforementioned problems a method for diagnosing an evaporative emission control system is provided. The method includes during a first state of a vapor blocking valve, determining a first rate of change of a vacuum in a fuel tank, during a second state of the vapor blocking valve different from the first state, determining a second rate of change of the fuel tank vacuum, and diagnosing an operational condition of the vapor blocking valve based on the first and second rates of change. When multiple rates of change of the fuel tank vacuum are used for diagnostics a more robust and reliable diagnostic routine can be achieved. In one example, the first and second rates may be compared to determine the operational state of the vapor blocking valve. When the diagnostic routine utilizes a vacuum bleed-up rate comparison the diagnostic routine may be applied to a variety of vapor recovery systems with differently sized notches, fuel tanks, vapor storage canisters, etc., without having to recalibrate diagnostic thresholds, if desired. Consequently, the applicability of the diagnostic technique is broadened.

In one example, the vapor blocking valve allows a metered fuel vapor flow there through in a closed state. In this way, the fuel tank pressure buildup during idle-stop conditions can be reduced while reducing the amount of vapor canister loading during such conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows an example of a hybrid vehicle.

FIG. 3 shows a first example of a vapor blocking valve.

FIG. 4 shows a second example of a vapor blocking valve.

DETAILED DESCRIPTION

A robust evaporative emission control system diagnostic technique is described herein. The diagnostic routine, may include in one example, determining the rate of change of a vacuum in a fuel tank during different states of a vapor blocking valve. For instance, the vapor blocking valve may be commanded closed while a first rate of change of the fuel tank vacuum is measured and then commanded open while a second rate of change of the fuel tank vacuum is measured. The rates of change of the vacuum are then compared to one another or otherwise processed to determine the operational state of the vapor blocking valve. For instance, the comparison of the rates may indicate that the vapor blocking valve is stuck open or closed when a ratio of the second rate of change over the first rate of change is less than or approximately equal to one. On the other hand, when a ratio of the second rate of change over the first rate of change is greater than one it may be ascertained that the vapor blocking valve is functioning as desired. Using a ratio between the rates of change of the vacuum to establish the operational state of the vapor blocking valve allows a common calibration method to be used across a wide range of engines and therefore vehicles. In this way, the diagnostic method may be efficiently used in a variety of different vehicles, engines, etc., due to the normalization of the diagnostic method, thereby reducing manufacturing costs. In one example, the rates of change of the fuel tank vacuum may be clipped and/or normalized prior to comparison of the rates of change to reduce variability caused by fuel movement (e.g., slosh) in the fuel tank. As a result, the confidence of the diagnostic routine may be increased during variable driving conditions (e.g., rough road conditions).

Figure 1:
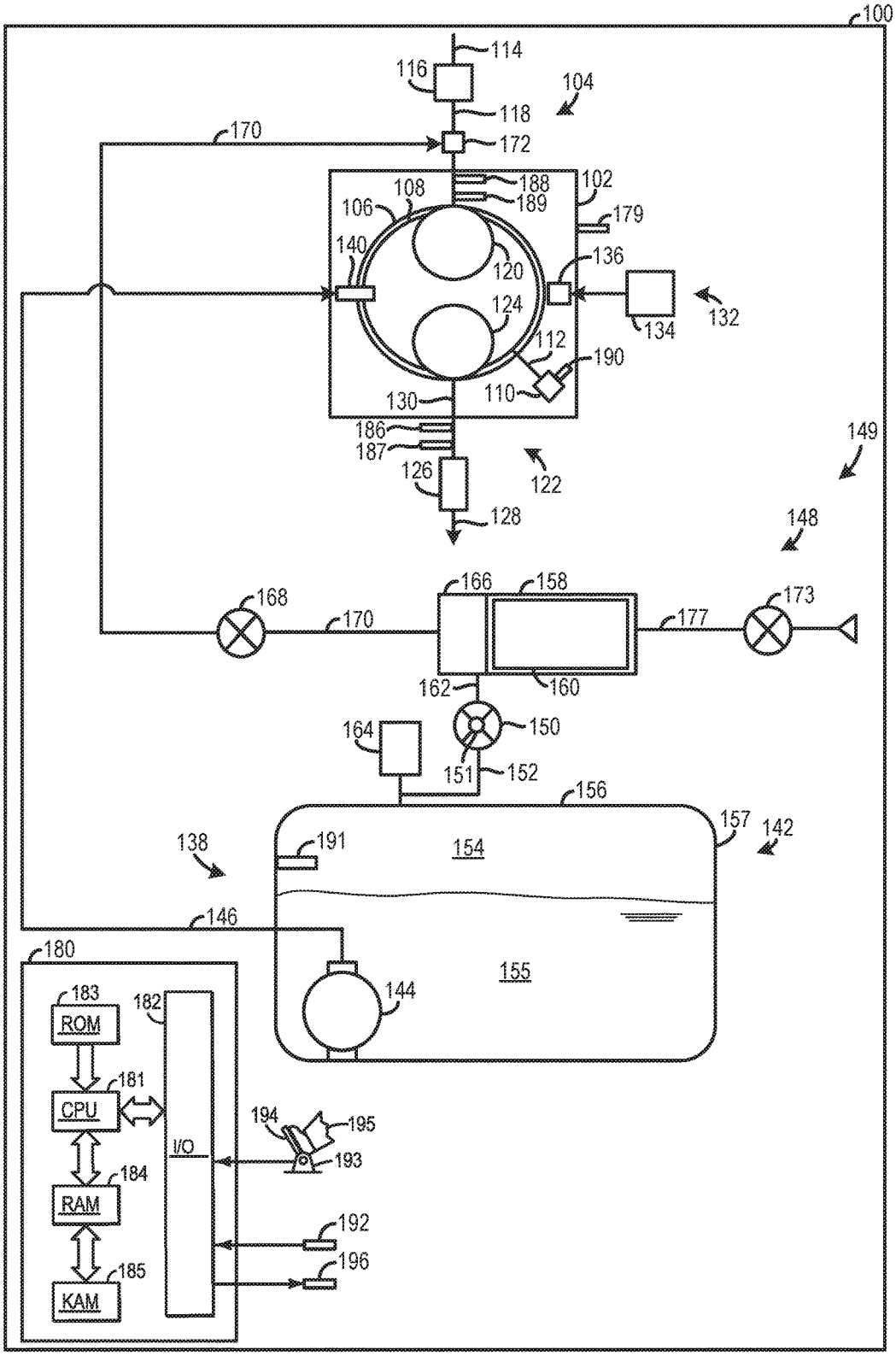
FIG. 1 shows a schematic depiction an engine and evaporative emission control system.
Figure 5:
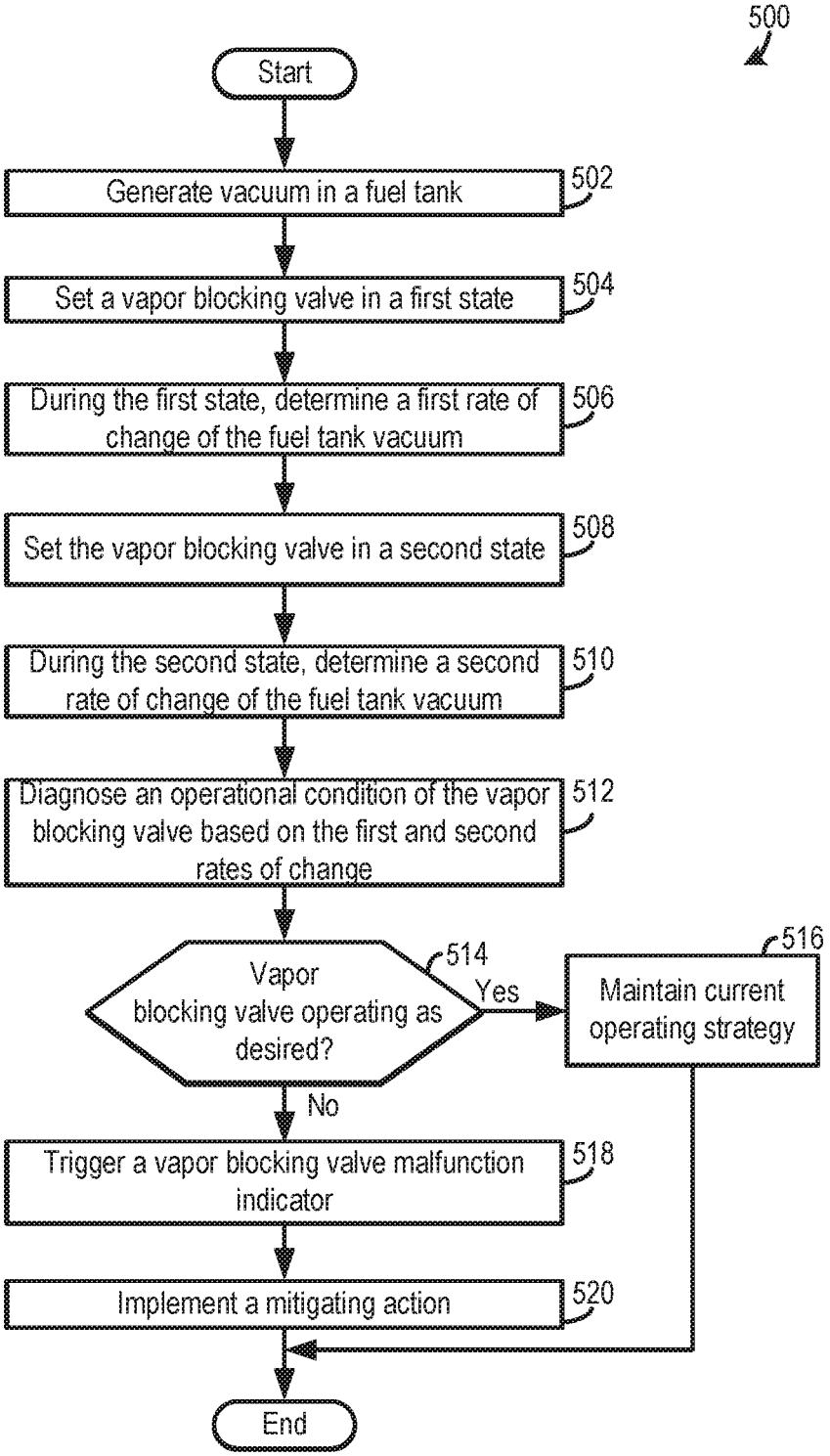
FIG. 5 shows a diagnostic method for an evaporative emission control system.
Figure 6:
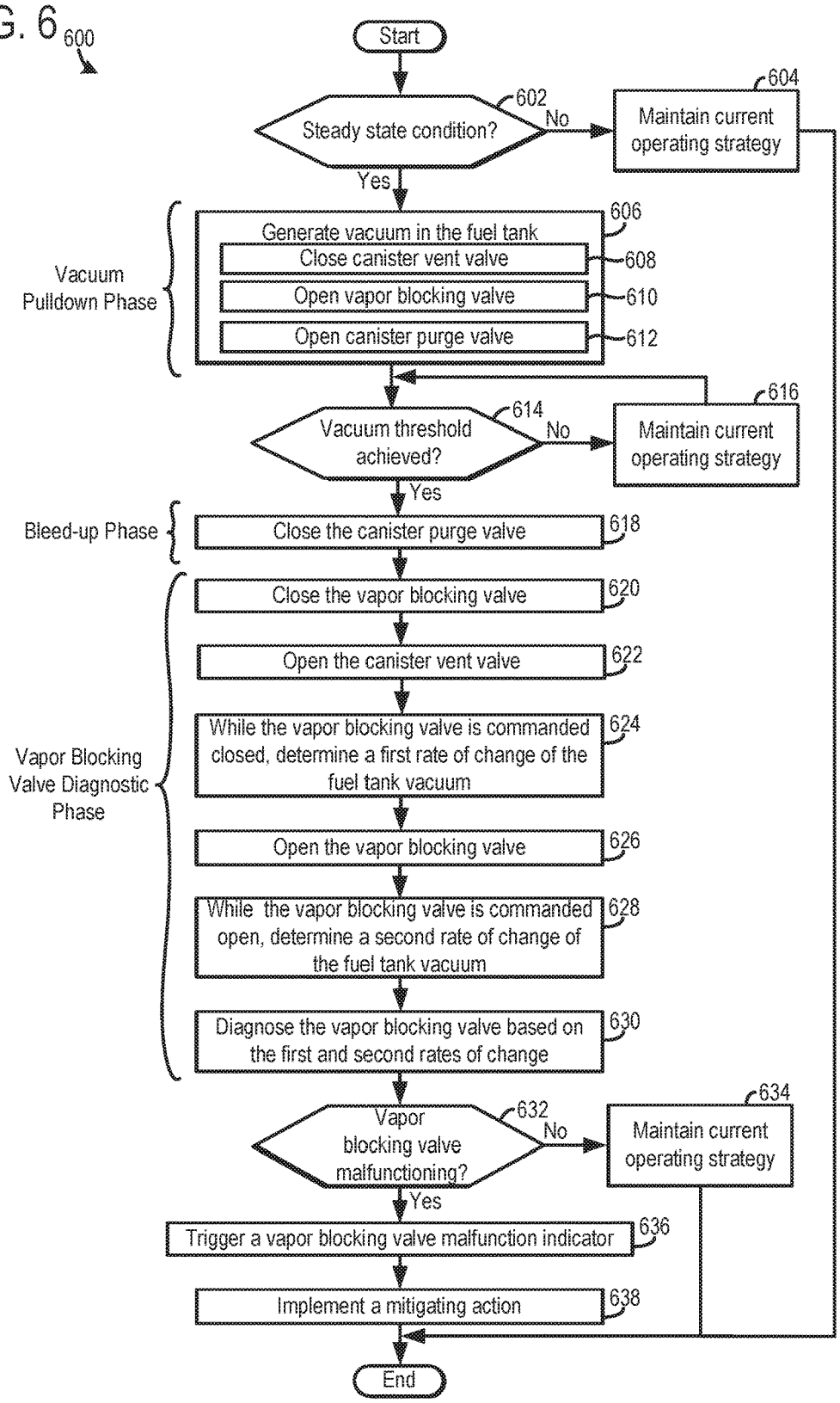
FIG. 6 shows a more detailed diagnostic method for an evaporative emission control system.
Figure 7:
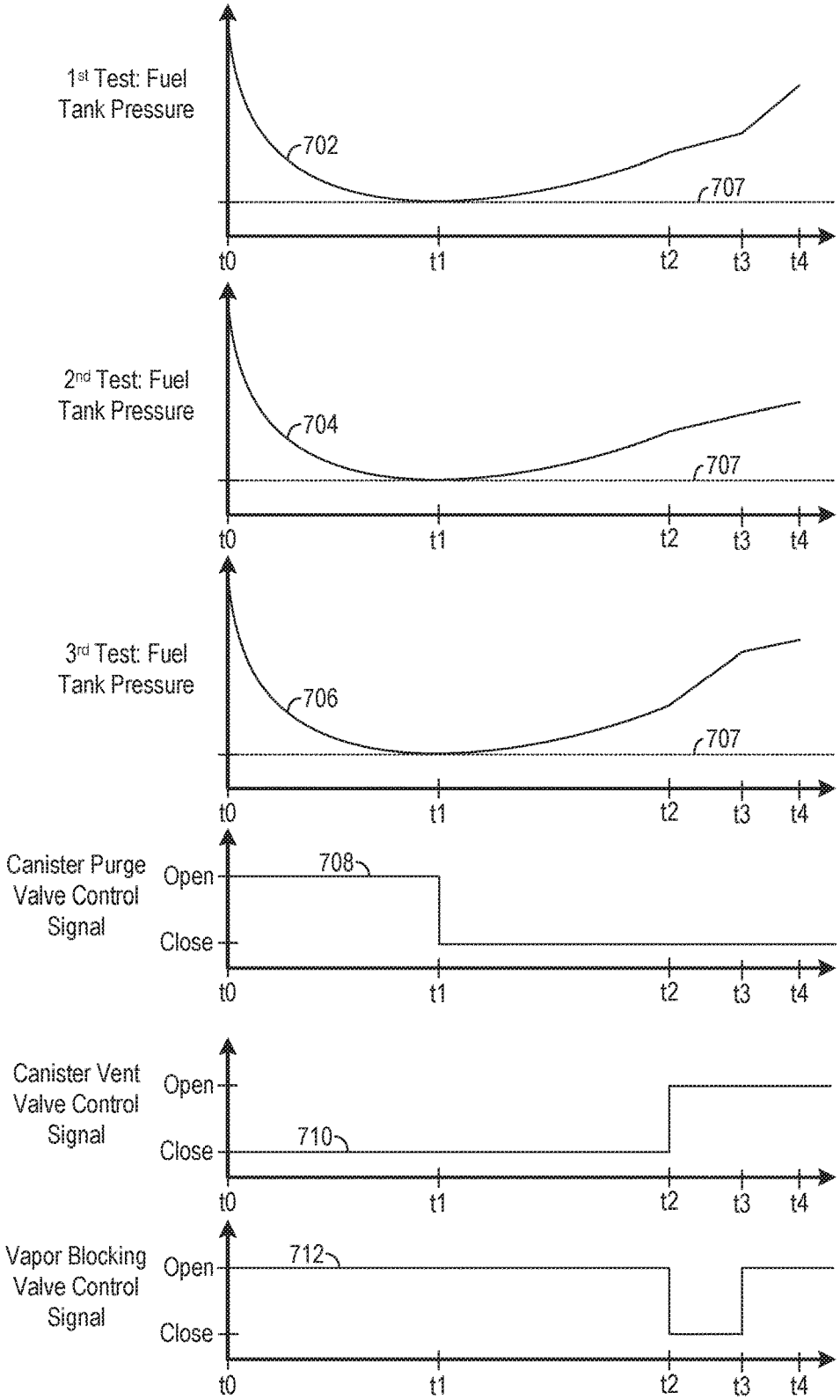
FIG. 7 shows fuel tank pressure graphs and control signals during a vapor blocking valve diagnostic routine.
Figure 8:
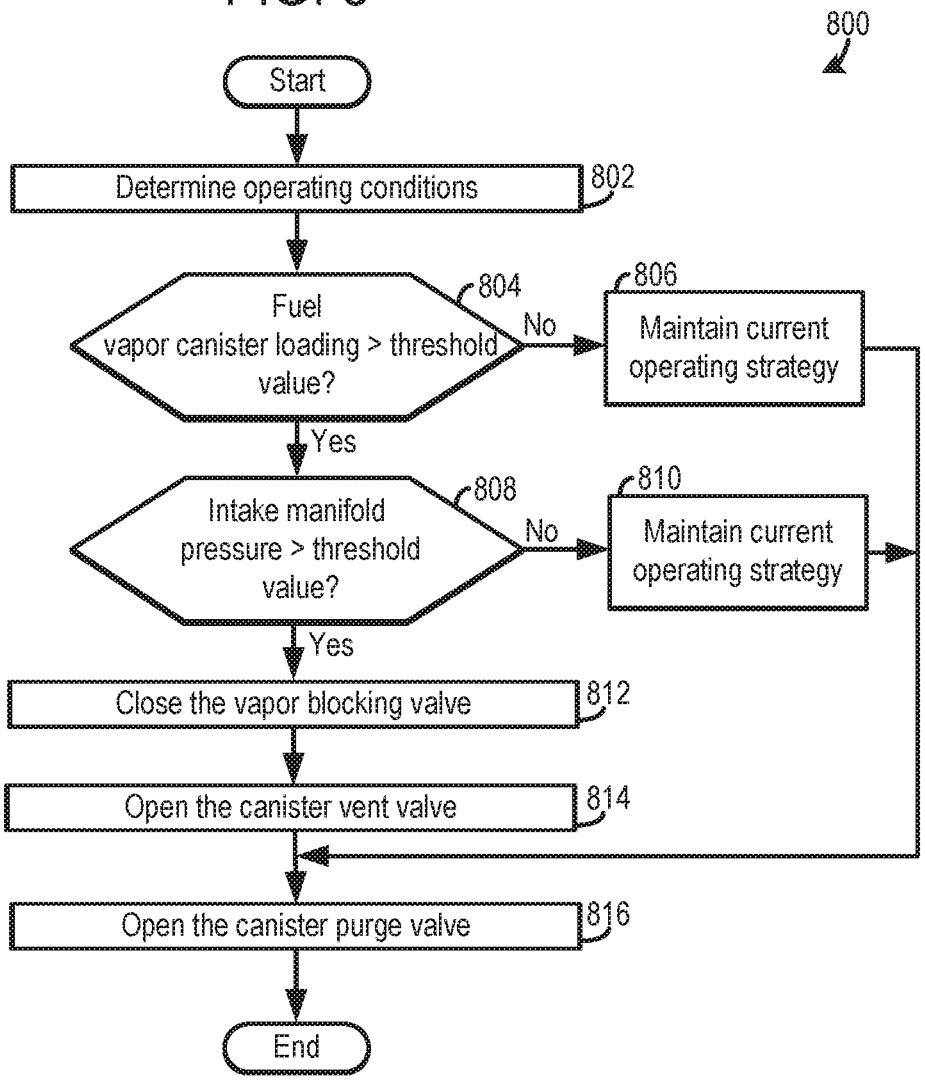
FIG. 8 shows a method for purging a fuel vapor canister in an evaporative emission control system.

FIG. 1 shows a depiction of a vehicle including an evaporative emission control system. FIG. 2 shows an example hybrid vehicle. FIGS. 3 and 4 show different examples of vapor blocking valves with different breathing components included in the evaporative emission control system, shown in FIG. 1. FIGS. 5 and 6 show diagnostic routines for an evaporative emission control system. FIG. 7 shows pressure graphs, control signals, etc., during an example of a diagnostic routine for the evaporative emission control system. FIG. 8 shows a method for purging a fuel vapor canister.

FIG. 1 shows a schematic representation of a vehicle 100 including an internal combustion engine 102. Although, FIG. 1 provides a schematic depiction of various engine and engine system components, it will be appreciated that at least some of the components may have different spatial positions and greater structural complexity than the components shown in FIG. 1.

An intake system 104 providing intake air to a cylinder 106, is also depicted in FIG. 1. It will be appreciated that the cylinder may be referred to as a combustion chamber. A piston 108 is positioned in the cylinder 106. The piston 108 is coupled to a crankshaft 110 via a piston rod 112 and/or other suitable mechanical component. It will be appreciated that the crankshaft 110 may be coupled to a transmission which provides motive power to a drive wheel. Although, FIG. 1 depicts the engine 102 with one cylinder. The engine 102 may have additional cylinders, in other examples. For instance, the engine 102 may include a plurality of cylinders that may be positioned in banks.

The intake system 104 includes an intake conduit 114 and a throttle 116 coupled to the intake conduit. The throttle 116 is configured to regulate the amount of airflow provided to the cylinder 106. For instance, the throttle 116 may include a rotatable plate varying the flowrate of intake air passing there through. In the depicted example, the throttle 116 feeds air to an intake conduit 118 (e.g., intake manifold). In turn, the intake conduit 118 directs air to an intake valve 120. The intake valve 120 opens and closes to allow intake airflow into the cylinder 106 at desired times. The intake valve 120, may include in one example, a poppet valve with a stem and a valve head seating and sealing on a cylinder port in a closed position.

Further, in other examples, such as in a multi-cylinder engine additional intake runners may branch off the intake conduit 118 and feed intake air to other intake valves. It will be appreciated that the intake conduit 118 and the intake valve 120 are included in the intake system 104. Moreover, the engine shown in FIG. 1 includes one intake valve and one exhaust valve. However, in other examples, the cylinder 106 may include two or more intake and/or exhaust valves.

An exhaust system 122 configured to manage exhaust gas from the cylinder 106 is also included in the vehicle 100, depicted in FIG. 1. The exhaust system 122 includes an exhaust valve 124 designed to open and close to allow and inhibit exhaust gas flow to downstream components from the cylinder. For instance, the exhaust valve may include a poppet valve with a stem and a valve head seating and sealing on a cylinder port in a closed position.

The exhaust system 122 also includes an emission control device 126 coupled to an exhaust conduit 128 downstream of another exhaust conduit 130 (e.g., exhaust manifold). The emission control device 126 may include filters, catalysts, absorbers, combinations thereof, etc., for reducing tailpipe emissions. The engine 102 also includes an ignition system 132 including an energy storage device 134 designed to provide energy to an ignition device 136 (e.g., spark plug). For instance, the energy storage device 134 may include a battery, capacitor, flywheel, etc. Additionally or alternatively, the engine 102 may perform compression ignition.

FIG. 1 also shows a fuel delivery system 138. The fuel delivery system 138 provides pressurized fuel to a fuel injector 140. In the illustrated example, the fuel injector 140 is a direct fuel injector coupled to cylinder 106. Additionally or alternatively, the fuel delivery system 138 may also include a port fuel injector designed to inject fuel upstream of the cylinder 106 into the intake system 104. For instance, the port fuel injector may be an injector with a nozzle spraying fuel into an intake port at desired times. The fuel delivery system 138 includes a fuel tank 142 and a fuel pump 144 designed flow pressurized fuel to downstream components. For instance, the fuel pump 144 may be an electric pump with a piston and an inlet in the fuel tank that draws fuel into the pump and delivers pressurized fuel to downstream components. However, other suitable fuel pump configurations have been contemplated. Furthermore, the fuel pump 144 is shown positioned within the fuel tank 142. Additionally or alternatively the fuel delivery system may include a second fuel pump (e.g., higher pressure fuel pump) positioned external to the fuel tank. A fuel line 146 provides fluidic communication between the fuel pump 144 and the fuel injector 140. The fuel delivery system 138 may include additional components such as a higher-pressure pump, valves (e.g., check valves), return lines, etc., to enable the fuel delivery system to inject fuel at desired pressures and time intervals.

During engine operation, the cylinder 106 typically undergoes a four-stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and the exhaust valve are closed. The piston moves toward the cylinder head so as to compress the air within the combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited via a spark from an ignition device, resulting in combustion. However, in other examples, compression may be used to ignite the air fuel mixture in the combustion chamber. During the expansion stroke, the expanding gases push the piston back to BDC. A crankshaft converts this piston movement into a rotational torque of the rotary shaft. During the exhaust stroke, in a traditional design, exhaust valve is opened to release the residual combusted air-fuel mixture to the corresponding exhaust passages and the piston returns to TDC.

The vehicle 100 also includes an evaporative emission control system 148. The evaporative emission control system 148 may be included in a vehicle system 149 that also includes the fuel delivery system 138, in some instances. The evaporative emission control system 148 may include the fuel tank 142 and a vapor blocking valve 150 coupled to a vapor line 152 extending into the fuel tank 142. Specifically, the vapor line 152 extends into the fuel tank 142 in a region 154 above liquid fuel 155 (e.g., gasoline, diesel, alcohol, combinations thereof, etc.,) stored therein where fuel vapors may reside. Thus, the vapor line 152 may extend through a top wall 156 or an upper section of a sidewall 157 of the fuel tank, in some instances. The vapor blocking valve 150 is designed to open and close to allow and inhibit fuel vapor flow there through. For instance, the vapor blocking valve 150 may be an electromagnetic valve with mechanical components for flow adjustment. However, other suitable vapor blocking valve types have been contemplated. The vapor blocking valve 150 also includes a breathing component 151. The breathing component 151 may be designed to allow a metered amount of gas (e.g., fuel vapor, air, etc.,) flow there through when the vapor blocking valve 150 is closed. The breathing component 151 reduces the likelihood of a fuel tank overpressure condition when the valve is closed, during an idle-stop condition for instance. Consequently, the likelihood of fuel tank damage caused by an overpressure condition is reduced, thereby improving the fuel delivery system's reliability and longevity.

The evaporative emission control system 148 further includes a fuel vapor canister 158 designed to store fuel vapor. The fuel vapor canister 158 may include carbon sections 160 (e.g., activated carbon sections) that capture fuel vapor. The fuel vapor canister 158 receives fuel vapor from the vapor blocking valve 150 via a vapor line 162 when the valve is in an open position. A pressure sensor 164 is shown coupled to the vapor line 152. Thus, the pressure sensor 164 may be configured to monitor the pressure in the fuel tank 142. For instance, the pressure sensor 164 may be a pressure transducer, in one instance. A buffer canister 166 may also be included in the evaporative emission control system 148 between the fuel vapor canister 158 and the engine 102 and the fuel vapor canister. The buffer canister may act to reduce any large hydrocarbon or fuel vapor spikes going to the engine to prevent an over rich condition. Thus, the buffer canister may act to dampen any fuel vapor spikes flowing between the fuel tank and the engine.

A canister purge valve 168 is positioned in a vapor line 170 extending between the fuel vapor canister 158 and the intake system 104 and specifically the intake conduit 118 at a junction 172, in the illustrated example. However, in other examples the fuel vapor may be routed to other suitable locations in the intake system 104. At the junction 172, the vapor line 170 opens into the intake conduit 118.

The evaporative emission control system 148 may further include a canister vent valve 173. In one example, the canister vent valve may be included in an evaporative leak check module (ELCM). In such an example, the ELCM may include a pump and a pressure sensor. The pump may be vacuum pump and the pump and the valve may operate in tandem during purge operation to flow air upstream through the fuel vapor canister 158 and eventually into the intake system 104. However, in other examples, the pump and the pressure sensor may not be included in the system.

The canister vent valve 173 may assist in flowing air into the fuel vapor canister 158 to flow fuel vapor through the vapor line 170 and into the intake system 104. The canister vent valve 173 is shown coupled to a line 177 coupled to the fuel vapor canister 158.

FIG. 1 also shows a controller 180 in the vehicle 100. Specifically, controller 180 is shown in FIG. 1 as a conventional microcomputer including: microprocessor unit 181, input/output ports 182, read-only memory 183, random access memory 184, keep alive memory 185, and a conventional data bus. Controller 180 is configured to receive various signals from sensors coupled to the engine 102. The sensors may include engine coolant temperature sensor 179, exhaust gas composition sensor 186, exhaust gas airflow sensor 187, an intake airflow sensor 188, manifold pressure sensor 189, engine speed sensor 190, a fuel tank pressure sensor 191, ambient pressure sensor 192, pressure sensor 164, etc. Additionally, the controller 180 is also configured to receive throttle position (TP) from a pedal position sensor 193 coupled to a pedal 194 actuated by an operator 195.

Additionally, the controller 180 may be configured to trigger one or more actuators and/or send commands to components. For instance, the controller 180 may trigger adjustment of the throttle 116, fuel injector 140, vapor blocking valve 150, canister vent valve 173, fuel pump 144, canister purge valve 168, fuel pump 144, etc. Specifically in one example, the controller 180 may send signals to an actuator in the vapor blocking valve 150 that opens and/or closes the valve to facilitate valve adjustment. Furthermore, the controller 180 may be configured to send control signals to actuators in the fuel pump 144 and the fuel injector 140 to control the amount and timing of fuel injection provided to the cylinder 106. The controller 180 may also send control signals to the throttle 116 to vary engine speed. The other adjustable components receiving commands from the controller may also function in a similar manner. A vapor blocking valve degradation indicator 196 is also shown receiving signals from the controller 180. The vapor blocking valve degradation indicator 196 may include an audio, visual, and/or haptic indicator. For instance, the vapor blocking valve degradation indicator 196 may include a light on a dash panel in a vehicle cabin. Additionally or alternatively, the vapor blocking valve degradation indicator may be a flag in an onboard diagnostic system. For instance, a vehicle owner or technician may have a computing device interfacing with the onboard diagnostic system that sends a flag to the computing device indicating degradation of the vapor blocking valve.

Therefore, the controller 180 receives signals from the various sensors and employs the various actuators to adjust engine operation based on the received signals and instructions stored in memory (e.g., non-transitory memory) of the controller. Thus, it will be appreciated that the controller 180 may send and receive signals from the evaporative emission control system 148. For example, adjusting the vapor blocking valve 150 may include commanding device actuators to adjust components in the vapor blocking valve to trigger opening and closing of the valve, as discussed above.

In yet another example, the amount of component, device, actuator, etc., adjustment may be empirically determined and stored in predetermined lookup tables and/or functions. For example, one table may correspond to conditions related to canister purge valve position and another table may correspond to conditions related to vapor blocking valve position. Moreover, it will be appreciated that the controller 180 may be configured to implement the methods, control strategies, etc., described herein.

In one example, the controller 180 may include instructions stored in the memory executable by the processor to monitor a pressure in the fuel tank as well as monitor an ambient temperature. Monitoring the pressure and temperature may include receiving signals from pressure and temperature sensors and interpreting said signals, in one example. The controller 180 may also include computer readable instructions stored on non-transitory memory that when executed, cause the controller 180 to generate a vacuum in the fuel tank 142. For instance, the canister vent valve 173 may be closed while the canister purge valve 168 and the vapor blocking valve 150 are opened to generate a vacuum in the fuel tank. Further, in such an example, the vapor blocking valve may then be commanded into a first state and a second state. In one example, the first state may be a closed state and the second state may be an open state. However, other valve states have been contemplated, such as a partially open state and a fully opened state, for instance. While the vapor blocking valve 150 is commanded to be placed in the first state (e.g., commanded closed) a first rate of change of the fuel tank vacuum may be determined (e.g., measured) and while the vapor blocking valve is commanded to be placed in the second state (e.g., commanded open) a second rate of change of the fuel tank vacuum may be determined. The rates of change of the vacuum in the fuel tank may be determined using regression analysis on signals received from a pressure sensor coupled to and/or positioned within the fuel tank, in one example. When the rates of change are determined using regression analysis the confidence in the measured rates of change of the fuel tank vacuum are increased.

However, other techniques for determining the rates of change of the fuel tank vacuum may be used, in other examples. Further, in one example, the first and second states may occur when ambient condition variations (e.g., ambient temperature and/or pressure variations) are within a threshold range. For instance, the first and second states may occur when the ambient temperature and/or pressure fluctuations are less than a predetermined range. Examples of values for the threshold fluctuations may include a temperature range within 10° C., 15° C., 20° C., etc., and a pressure range within 5 kPa, 10 kPa, 20 kPa, etc. In this way, the vacuum pressure measurements may be taken when the ambient condition fluctuations are within a desired range. However, in other examples, the vacuum pressure may be determined when ambient condition fluctuations are outside a desired range.

The two rates of change of the vacuum are then used by the controller 180 to diagnose an operational condition of the vapor blocking valve. The operational condition may include a malfunctioning condition (e.g., a stuck open condition, stuck closed condition, etc.,) a normal operating condition, etc. Specifically, in one example, a ratio between the first and second rates of change may be calculated and if the ratio is greater than one it may be determined that the vapor blocking valve is functioning as desired. For instance, when the second rate of change is greater than the first rate of change it can be ascertained that the vapor blocking valve is opened as commanded while the second rate of change is measured and the fuel tanks is venting to atmosphere, as anticipated. However, when the second rate of change is equal to or less than the first rate of change it can be ascertained that the vapor blocking valve is stuck (e.g., stuck open or closed). Specifically, when the first and second rates of change are substantially equal (e.g., within a predetermined range of rates) it may be determined that the valve is stuck closed because the slopes are both primarily influenced by the vacuum decay through the notch. When, the second rate of change is less than the first rate of change it may be ascertained that the valve is stuck open. For instance, the first rate of change may be larger than the second rate of change when the valve is stuck open because vacuum decay drives the rate of change of the fuel tank pressure and will exhibit an asymptotic profile as the rate of change approaches atmospheric pressure. It will be appreciated that other techniques for ascertaining vapor blocking valve operational functionality based on the first and second rates of change have been contemplated.

Additionally, in some examples, the controller 180 may hold instructions for clipping and/or normalizing the first and/or second rates of change during vapor blocking valve diagnostics. Clipping and/or normalizing the rates of change reduces the variability in the slopes caused by fuel movement in the fuel tank. Consequently, the confidence of the vapor blocking valve diagnostic routine is increased. Clipping may include, in one example, limiting a signal once the signal exceeds a threshold value. Additionally, in one example, normalizing may include bringing a probability distribution of adjusted values into alignment. Further, in one example, clipping the rates of change of fuel tank pressure may include clipping a minimum slope at maximum kinetic energy curve at each starting tank pressure to mitigate potential bad slope calculations due to fuel slosh and vehicle dynamics. However, other types of clipping calculations have been contemplated. Furthermore, normalization may be used to linearize the data due to the second order polynomial effects from flow through an orifice as well as volume changes inside tank during vehicle dynamics. However, in other examples, the rates of change may not be normalized and/or clipped. In one example, the clipping may be carried out according to equations 1 and 2 below.

$$pgm_vbv_slope_mn = lookup_2d(fn pgm_vbv_slope, pgm_vbv_tpr_strt) + (pgm_fuel_lvl * pgm_fuel_lvl * pgm_vbv_opn_fli_mul) \quad \text{(equation 1)}$$

$$pgm_vbv_slope = f32max(pgm_vbv_slope_calculated, pgm_vbv_slope_mn) \quad \text{(equation 2)}$$

The terms in the equations 1 and 2 are defined as follows:

pgm_vbv_slope_min: minimum slope of fuel tank pressure pgm_vbv_slope: slope of fuel tank pressure pgm_vbv_tpr_start: starting fuel tank pressure pgm_fuel_level*pgm_fuel_level*pgm_vbv_opn_fli_mul: fuel level multiplier term It will be appreciated that a lookup value is used in the equation for a minimum clipping value to reduce aberrations in slope calculation caused by fuel slosh. Consequently, the confidence in the fuel tank pressure slope calculation can be increased, thereby increasing the confidence in the vapor blocking valve diagnostic routine.

Referring to FIG. 2, the figure schematically depicts a vehicle 201 with a hybrid propulsion system 200. Hybrid propulsion system 200 includes an internal combustion engine 202. It will be appreciated that the hybrid propulsion system 200 may be included in the vehicle 100 shown in FIG. 1. Thus, the vehicle 201 and the engine 202 shown in FIG. 2 may include at least a portion of the features, components, systems, etc., of the vehicle 100 and engine 102 described above with regard to FIG. 1 or vice versa.

The engine 202 is coupled to a transmission 204. The transmission 204 may be a manual transmission, automatic transmission, or combinations thereof. Further, various additional components may be included, such as a torque converter, and/or other gears such as a final drive unit, etc. The transmission 204 is shown coupled to a drive wheel 206, which in turn is in contact with a road surface 208.

In this example embodiment, the hybrid propulsion system 200 also includes an energy conversion device 210, which may include a motor, a generator, among others and combinations thereof. The energy conversion device 210 is further shown coupled to an energy storage device 212, which may include a battery, a capacitor, a flywheel, a pressure vessel, etc. The energy conversion device can be operated to absorb energy from vehicle motion and/or the engine and convert the absorbed energy to an energy form suitable for storage by the energy storage device (i.e., provide a generator operation). The energy conversion device can also be operated to supply an output (power, work, torque, speed, etc.,) to the drive wheel 206 and/or engine 202 (i.e., provide a motor operation). It should be appreciated that the energy conversion device may, in some embodiments, include only a motor, only a generator, or both a motor and generator, among various other components used for providing the appropriate conversion of energy between the energy storage device and the vehicle drive wheel and/or engine.

The depicted connections between engine 202, energy conversion device 210, transmission 204, and drive wheel 206 indicate transmission of mechanical energy from one component to another, whereas the connections between the energy conversion device and the energy storage device may indicate transmission of a variety of energy forms such as electrical, mechanical, etc. For example, torque may be transmitted from engine 202 to drive the vehicle drive wheel 206 via transmission 204. As described above energy storage device 212 may be configured to operate in a generator mode and/or a motor mode. In a generator mode, the hybrid propulsion system 200 absorbs some or all of the output from engine 202 and/or transmission 204, which reduces the amount of drive output delivered to the drive wheel 206, or the amount of braking torque to the drive wheel 206. Such operation may be employed, for example, to achieve efficiency gains through regenerative braking, increased engine efficiency, etc. Further, the output received by the energy conversion device may be used to charge energy storage device 212. In the motor mode, the energy conversion device may supply mechanical output to engine 202 and/or transmission 204, for example, by using electrical energy stored in an electric battery.

Hybrid propulsion embodiments may include full hybrid systems, in which the vehicle can run on just the engine, just the energy conversion device (e.g., motor), or a combination of both. Assist or mild hybrid configurations may also be employed, in which the engine is the primary torque source, with the hybrid propulsion system acting to selectively deliver added torque, for example during tip-in or other conditions. Further still, starter/generator and/or smart alternator systems may also be used. The various components described above with reference to FIG. 2 may be controlled by a vehicle controller such as the controller 180, shown in FIG. 1.

From the above, it should be understood that the exemplary hybrid propulsion system 200 is capable of various modes of operation. In a full hybrid implementation, for example, the propulsion system may operate using energy conversion device 210 (e.g., an electric motor) as the only torque source propelling the vehicle. This "electric only" mode of operation may be employed during braking, low speeds, while stopped at traffic lights, etc., in one example. However, in other examples the "electric only" mode may be implemented over a wider range of operating conditions such as at higher speeds. In another mode, engine 202 is turned on, and acts as the only torque source powering drive wheel 206. In still another mode, which may be referred to as an "assist" mode, energy conversion device 210 may supplement and act in cooperation with the torque provided by engine 202. As indicated above, energy conversion device 210 may also operate in a generator mode, in which torque is absorbed from engine 202 and/or transmission 204. Furthermore, energy conversion device 210 may act to augment or absorb torque during transitions of engine 202 between different combustion modes (e.g., during transitions between a spark ignition mode and a compression ignition mode). Additionally, an external energy source 214 may provide power to the energy storage device 212. The external energy source 214 may be a charging station outlet or other suitable power outlet, a solar panel, a portable energy storage device, etc., for instance.

FIG. 3 shows an example of a vapor blocking valve 300 that may be included in the evaporative emission control system 148, shown in FIG. 1. Thus, the vapor blocking valve 300 may be an example of the vapor blocking valve 150, shown in FIG. 1. The vapor blocking valve 300 is shown including a breathing component 302. In the illustrated example, the breathing component 302 is an opening in a valve sealing component 304. The size of the opening 302 may be selected to allow a desired amount of fuel vapor to flow there through when the vapor blocking valve 300 is closed. For instance, the opening 302 may be sized to reduce the likelihood of an over pressure condition in the fuel tank while also reducing the likelihood of fuel vapor canister overloading.

FIG. 4 shows a second example of a vapor blocking valve 400 that may be included in the evaporative emission control system 148 shown in FIG. 1. The vapor blocking valve 400 is shown including a sealing surface 402 and a breathing component 404, embodied as a notch, in the sealing surface. It will be appreciated that a valve sealing component may interact with the sealing surface 402 during opening and closing of the valve. For instance, the valve sealing component may seat on the sealing surface 402 when the valve is closed and may be spaced away from the sealing surface 402 when the valve is opened. In the closed position the notch 404 allows a metered amount of fuel vapor to flow there through. Again, the notch 404 may be sized to allow a desired amount of fuel vapor to flow there through when the vapor blocking valve 400 is closed. In this way, the likelihood of an overpressure condition in the fuel tank may be reduced while also reducing the likelihood of overloading the fuel vapor canister.

FIGS. 3-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 5 shows a diagnostic method 500 for use in an evaporative emission control system. The diagnostic method 500 and/or the other methods described herein may be implemented in the evaporative emission control system described above with regard to FIGS. 1-4, in one example. However, in other examples, the diagnostic method 500 and/or the other methods described herein may be carried out in other suitable evaporative emission control systems. It will be appreciated that method 500 may be implemented while the engine is operating and carrying out sequential combustion cycles. As such, engine operation may be an entry condition for method 500, in one example. Additional or alternative entry conditions for vapor blocking valve diagnostics may include, in some examples, a steady state cruising condition, temperature range, fuel level indicator (FLI) range, altitude range, etc. A steady state cruising condition may be a condition when a speed of the vehicle is within a predetermined range and/or when the rate of change of the speed of the vehicle is below a threshold value. Additionally, it will be appreciated that the aforementioned entry condition ranges may be predetermined. Furthermore, during vapor blocking valve diagnostics vapor purging from the purge canister may be suspended, in some examples.

At 502 the method includes generating a vacuum in a fuel tank. Generating a vacuum in a fuel tank may include closing a canister vent valve and opening a canister purge valve and a vapor blocking valve. In this way, the fuel tank may in fluidic communication with a vacuum in the intake system, thereby generating vacuum in the fuel tank. In one example, the valves may be sustained in the aforementioned configurations until the fuel tank reaches a desired vacuum threshold or threshold range. For instance, an example of a vacuum threshold value may be −8 in$H_2O$, −10 in$H_2O$, −20 in$H_2O$, etc. Further, in one example, after a desired vacuum is achieved in the fuel tank, the canister purge valve may be closed while the vapor blocking valve is kept open and the canister vent valve is kept closed.

Next at 504 the method includes setting the vapor blocking valve in a first state. For example, the vapor blocking valve may be commanded to close at step 504. However, other states of the vapor blocking valve have been contemplated. For example, the vapor blocking valve may be commanded open or partially open in the first state.

At 506 the method includes, while the vapor blocking valve is in the first state (e.g., commanded closed), determining (e.g., measuring) a first rate of change of the vacuum in the fuel tank. In one example, regression analysis (e.g., a least square method) may be used to determine the first rate of change of the vacuum from signals received from a pressure sensor coupled to the fuel tank. However, other suitable techniques for ascertaining the first rate of change of the vacuum in the fuel tank have been contemplated.

Next at 508 the method includes setting the vapor blocking valve in a second state. For example, the vapor blocking valve may be commanded to open at step 508. However, other states of the vapor blocking valve have been contemplated. For example, the vapor blocking valve may be commanded closed or partially closed in the second state.

At 510 the method includes, while the vapor blocking valve is in the second state (e.g., commanded open), determining (e.g., measuring) a second rate of change of the vacuum in the fuel tank.

Next at 512 the method includes diagnosing an operational condition of the vapor blocking valve based on the first and second rates of change. Diagnosing the vapor blocking valve may include clipping and/or normalizing the first and/or second rates of change. Clipping and/or normalizing the first and/or second rates of change reduces variability in the slopes caused by fuel slosh, thereby increasing the confidence in the diagnostic routine. Furthermore, the operational condition may be a malfunctioning condition (e.g., stuck open, stuck closed, etc.,), a normal operating condition, etc. It will be appreciated that the operational condition of the vapor blocking valve may be carried out using a comparison between the first and second rates of changes, such as a ratio between the rates of change, as previously discussed. In one specific example, vapor blocking valve diagnostic may be performed by evacuating the fuel tank to a threshold pressure (e.g., −8 in $H_2O$), performing the leak analysis, and then opening the canister vent valve and closing the vapor blocking valve. The vapor blocking valve diagnostic routine may further include calculating a closed slope of the fuel tank pressure, opening the canister vent valve, and calculating the open slope of the fuel tank pressure. Additionally, in such an example, vapor blocking valve diagnostics may include dividing the open slope of the fuel tank pressure by the closed slope of the fuel tank pressure to obtain a ratio. Since the closed slope may be more sensitive to noise as the system is semi-sealed, the clipping (according to a theoretical minimum value obtained by offline study, for instance) and normalizing may be performed on it to ensure it is robust. Therefore, if the calculated closed slope is not influenced by noise, it may be used in the diagnostic calculation (e.g., the calculation of the ratio between the rates of change of the fuel tank pressure). However, if the closed slope fuel tank pressure is influenced by noise the clipped and normalized slope may be used in the diagnostic calculation (e.g., the calculation of the ratio between the rates of change of the fuel tank pressure). For instance, if the closed slope fuel tank pressure is influenced by noise, the slope may be calculated using the clipped and normalized value ascertained using a look-up table, for instance. However, if the closed slope fuel tank pressure in not influenced by noise the measured rate of change of fuel tank pressure may be plugged directly into the ratio calculation. Further, in one example, a theoretical minimum value calculated using a look-up table may be used to clip the rates of change of the fuel tank pressure. At 514 the method includes determining if the vapor blocking valve is operating as desired. As previously discussed, a ratio between the first and second rates of change of the fuel tank vacuum may be utilized to determine vapor blocking valve functionality.

If it is determined that the vapor blocking valve is operating as desired (YES at 514) the method advances to 516. At 516 the method includes maintaining the current operating strategy for the engine, evaporative emission control system, fuel delivery system, etc. For instance, the vapor blocking valve may be commanded opened and closed based on a predetermined operating scheme. Specifically, in one instance, the vapor blocking valve may be commanded closed during an idle-stop condition and opened during other conditions.

However, if it is determined that the vapor blocking valve is not operating as desired (NO at 514) the method advances to 518. At 518 the method includes triggering a vapor blocking valve malfunction indicator and at 520 the method includes implementing one or more mitigating action(s). In one example, the mitigating action may include increasing the duration of a canister purge cycle and/or increasing the number of canister purge events. In another example, the mitigating action may include increasing manifold air pressure and implementing a canister purge event. In another example, the mitigating action may include rapidly commanding opening/closing of the vapor blocking valve. In yet another example, the mitigating action may include lowering a purge flow ramp rate occurring during a vapor canister purge event. For instance, the rate at which vapor canister purge flow is increased from a baseline value may be decreased. Thus, the canister purge valve may be opened up at a slower rate during a canister purge event when it is determined that the vapor blocking valve is degraded (e.g., malfunctioning), in one example.

In one example, the method 500 may be implemented regardless of the orientation of the fuel tank. For instance, the method 500 and the other methods described herein may be implemented regardless of fuel slosh. Thus, the method may include preventing the abortion of the method when fuel slosh surpasses a threshold level and/or when the fuel tank orientation surpasses a threshold angle. Fuel slosh may be expressed as a rate of change of the fuel tank angular orientation, in one example. However, numerous ways to express fuel slosh have been contemplated. In this way, the diagnostic routine may be implemented over a wider range of vehicle operating conditions.

Method 500 allows a robust diagnostic routine to be implemented in evaporative emission control system having a vapor blocking valve with a breathing component (e.g., notch, opening, etc.). The breathing component allows a metered amount of fuel vapor there through when the valve is closed. In this way, the system can achieve the benefits of the breathing components (e.g., reduction in likelihood of a fuel tank overpressure condition) while implementing a reliable diagnostic routine for the vapor blocking valve.

FIG. 6 shows a more detailed diagnostic method 600 for use in an evaporative emission control system. Certain method steps may be grouped into phases. For instance, in one example, step 606 may be characterized as a vacuum bleed down phase where the vacuum in the fuel tank is decreasing, step 618 may be characterized as a vacuum bleed up phase where the vacuum in the fuel tank is increasing, and steps 620-630 may be characterized as a vapor blocking valve diagnostic phase.

At 602 the method includes determining if a steady state condition is occurring in the engine. The steady state condition may include a condition where the engine is operating within a desired speed and/or load range. However, in other examples, it may be determined if the engine is running at step 602.

If it is determined that the steady state condition is not occurring (NO at 602) the method proceeds to 604 where the method includes maintaining the current operating strategy for the engine, evaporative emission control system, fuel delivery system, etc. For instance, fuel vapor canister loading and unloading may be implemented according to a predetermined technique. For instance, the fuel vapor canister may be unloaded when a desired vacuum level is generated in the intake system and the fuel vapor canister may be loaded during other conditions such as conditions when the intake system vacuum level is not achieved. However, other suitable system operating strategies have been contemplated.

On the other hand, if it is determined that the steady state condition is occurring (YES at 602) the method includes at 606 generating a vacuum in a fuel tank. In one example, generating a vacuum in the fuel tank may include steps 608-612. At 608 the method includes closing the canister vent valve, at 610 the method includes opening the vapor blocking valve, and at 612 the method includes opening the canister purge valve. It will be appreciated, that closing or opening a valve as described with regard to method 600 may include commanding a valve to open or close.

Next at 614 the method includes determining if a vacuum threshold or threshold range in the fuel tank has been achieved. The vacuum threshold may be, for example, −5 $inH_2O$, −8 $inH_2O$, −10 $inH_2O$, etc.

If a vacuum threshold has not been achieved in the fuel tank (NO at 614) the method moves to 616 where the method includes maintaining the current operating strategy for the engine, evaporative emission control system, fuel delivery system, etc. It will be appreciated that maintaining the current operating strategy may include keeping the canister vent valve closed and keeping the vapor blocking valve and canister purge valve opened.

On the other hand, if it is determined that the vacuum threshold has been achieved (YES at 614) the method advances to 618. At 618 the method includes closing the canister purge valve. Next at 620 the method includes closing the vapor blocking valve and at 622 the method includes opening the canister vent valve. At 624 the method includes determining (e.g., measuring) a first rate of change of the fuel tank vacuum while the vapor blocking valve is commanded closed. At 626 the method includes opening the vapor blocking valve and at 628 the method includes determining (e.g., measuring) a second rate of change of the fuel tank vacuum while the vapor blocking valve is commanded open. In one example, regression analysis (e.g., least square regression) may be used to determine the first and/or second rates of change of the fuel tank vacuum. In this way, the slope of the fuel tank vacuum may be accurately determined. However, other suitable techniques for calculating the rates of change of the fuel tank vacuum have been envisioned.

At 630 the method includes diagnosing the vapor blocking valve based on the first and second rates of change. For instance, the rates of change of the fuel tank vacuum may be compared to determine if the vapor blocking valve is functioning as desired or malfunctioning (e.g., stuck open, stuck closed, etc.). In one example, a ratio of the second rate of change over the first rate of change may be calculated. A ratio that is greater than one may indicate that the vapor blocking valve is functioning as desired, as previously discussed. A ratio that is less than or equal to one may indicate that the vapor blocking valve is malfunctioning. Specifically, a ratio that is less than one may indicate that the vapor blocking valve is stuck open and a ratio that is substantially equal to one may indicate that the vapor blocking valve is stuck in a closed position. A ratio that is substantially equal to one may include a ratio that is within an acceptable range around one which takes into account inaccuracies in fuel tank pressure measurements and other uncertainties in the diagnostic routine.

Additionally, in some examples, the first and/or second rates of change may be clipped and/or normalized during diagnosis of the vapor blocking valve, as previously discussed, to reduce variability in the rates of change caused by the motion of fuel in the fuel tank. In one example, the diagnostic routine may be sustained regardless of fuel slosh in the fuel tank when the rates of change of the vacuum are clipped and/or normalized.

Next at 632 the method includes determining if the vapor blocking valve is malfunctioning (e.g., stuck open or closed). As previously discussed the ratio of the rates of change of the fuel tank vacuum may be used to determine if the vapor blocking valve is stuck open or closed. If it is determined that the vapor blocking valve is not malfunctioning (NO at 632) and the vapor blocking valve is functioning as desired the method proceeds to 634. At 634 the method includes maintaining the current operating strategy for the engine, evaporative emission control system, fuel delivery system, etc. For instance, the vapor blocking valve may be operated according to a predetermined control strategy to load the fuel vapor canister during selected conditions.

However, if it is determined that the vapor blocking valve is malfunctioning (YES at 634) the method moves to 636 where the method includes triggering a vapor blocking valve malfunction indicator. For instance, the indicator may include an audio, haptic, and/or visual indicator. It will be appreciated that when it is determined that the vapor blocking valve is stuck closed the cause of issues such as premature shutoff during refueling can be identified. At 638 the method includes implementing one or more mitigating action(s). The mitigating actions may include the actions described with regard to step 520 and/or other suitable mitigating actions.

Method 600 allows a robust diagnostic routine to be implemented in an evaporative emission control system having a vapor blocking valve with a breathing component (e.g., notch or opening). As such, the system can efficiently diagnose the vapor blocking valve while leveraging the benefits of the breathing vapor blocking valve, such as reduced fuel tank pressure buildup and controlled vapor canister loading. It will be appreciated that using multiple rates of change to ascertain vapor blocking valve functionality allows the diagnostic routine to be applied to a variety of evaporative emission control systems having differently sized fuel tanks, vapor canisters, vapor blocking valves, etc., without having to recalibrate threshold values used in the diagnostic routine. Consequently, the production cost of the vehicle employing the evaporative emission control system may be reduced.

Now turning to FIG. 7, depicting examples of pressure graphs and control signal graphs during a diagnostic routine for an evaporative emission control system, such as the evaporative emission control system and diagnostic methods described above with regard to FIGS. 1-6. The example of FIG. 7 is drawn substantially to scale, even though each and every point is not labeled with numerical values. As such, relative differences in timings can be estimated by the drawing dimensions. However, other relative timings may be used, if desired. Furthermore, in each of the graphs time is represented on the abscissa. Additionally, the graphical control strategy of FIG. 7 is illustrated as a use case example and that numerous diagnostic strategies for the evaporative emission control systems have been contemplated.

A pressure plot for a fuel tank with a vapor blocking valve functioning as desired is indicated at 702. A pressure plot for a fuel tank with a vapor blocking valve that is stuck closed is indicated at 704. Additionally, a pressure plot for a fuel tank with a vapor blocking valve that is stuck open is indicated at 706. In each, of the pressure plots 702, 704, and 706, a vacuum pulldown phase occurs between $t_0$ and $t_1$. Furthermore, in each of the pressure plots 702, 704, and 706, a bleed-up phase occurs between $t_1$ and $t_2$. Furthermore, in each of the pressure plots 702, 704, and 706, a diagnostic phase occurs between $t_2$ and $t_4$. Additionally, vacuum thresholds 707 are indicated on each of the pressure plots 702, 704, and 706.

A canister purge valve control signal is indicated at 708. Specifically, an open and closed signal are shown on the ordinate. The open signal corresponds to a signal commanding the canister purge valve to be placed in an open position and a closed signal corresponds to a signal commanding the canister purge valve to be placed in a closed position.

A canister vent valve signal is indicated at 710. Specifically, an open and closed signal are shown on the ordinate. The open signal corresponds to a signal commanding the canister vent valve to be placed in an open position and a closed signal corresponds to a signal commanding the canister vent valve to be placed in a closed position.

A vapor blocking valve signal is indicated at 712. Specifically, an open and closed signal are shown on the ordinate. The open signal corresponds to a signal commanding the vapor blocking valve to be placed in an open position and a closed signal corresponds to a signal commanding the vapor blocking valve to be placed in a closed position.

During the vacuum pulldown phase occurring between $t_0$ and $t_1$ a vacuum in the fuel tank is generated by opening the canister purge valve and the vapor blocking valve and closing the canister vent valve.

During the bleed-up phase occurring between $t_1$ and $t_2$ the vacuum in the fuel tank slowly increases due to the canister purge valve being closed. Additionally, during the bleed-up phase the canister vent valve remains closed and the vapor blocking valve remains open.

During the diagnostic phase occurring between $t_2$ and $t_4$ the canister purge valve remains closed and the canister vent valve is opened. Additionally, between $t_2$ and $t_3$ the vapor blocking valve is closed and between $t_3$ and $t_4$ the vapor blocking valve is opened.

The slope of the pressure plot 702 between $t_3$ and $t_4$ is greater than the slope of the pressure plot 702 between $t_2$ and $t_3$. As such, when the slope of the pressure plot occurring between $t_3$ and $t_4$ is greater than the slope of the pressure plot occurring between $t_2$ and $t_3$ it may be ascertained that the vapor blocking valve is functioning as desired.

The slope of the pressure plot 704 between $t_3$ and $t_4$ is substantially equal to the slope of the pressure plot 704 between $t_2$ and $t_3$. As such, it may be ascertained that the vapor blocking valve is stuck closed when the slopes of the pressure plot occurring during the diagnostic phase remains substantially constant. The pressure plot 704 exhibits this profile due to the valve remaining closed and the breathing component driving the majority of the increase in pressure in the fuel tank during the diagnostic phase.

The slope of the pressure plot 706 between $t_3$ and $t_4$ is less than the slope of the pressure plot 704 between $t_2$ and $t_3$. As such, it may be ascertained that the vapor blocking valve is stuck open when the slope of the pressure plot during the diagnostic phase decreases. The pressure plot 706 exhibits this profile due to the fact that the vacuum is asymptotically decaying towards atmospheric pressure due to the canister vent valve being opened and the vapor blocking valve being stuck open.

FIG. 8 shows a method 800 for purging a vapor storage canister in an evaporative emission control system. Method 800 may be implemented by the evaporative emission control system, components, engine, etc., described above with regard to FIG. 1 or other suitable evaporative emission control systems, components, engines, etc. At 802 the method includes determining operating conditions such as engine speed, canister loading, engine load, manifold air pressure, throttle position, etc. It will be appreciated that method 800 may be implemented at a different time than the vapor blocking valve diagnostic methods described herein, such as method 500 and 600. In some examples, the diagnostic methods may override the vapor purge method to comply with emission standards, for instance. Additionally, in one example, vapor blocking valve diagnostics may not run when the fuel vapor canister is loaded, such as after a refueling event. Further in one example, during implementation of the diagnostic routine, vapor purge may be suspended.

Next at 804 the method includes determining if the fuel vapor canister loading is greater than a threshold value. If it is determined that the fuel vapor canister loading is not greater than the threshold value (NO at 804) the method advances to 806. At 806 the method includes maintaining current operating strategy in the vehicle, engine, evaporative emission control system, etc. After 806 the method advances to step 816.

However, if it is determined that the fuel vapor canister loading is greater than the threshold value (YES at 804) the method proceeds to 808. At 808 the method includes determining if the intake manifold pressure is greater than a threshold value. The threshold value may correspond to a value desired for canister purging. It will be appreciated that other factors may be used as entry conditions into a vapor purge routine including fuel injection strategy (e.g., fuel injection timing and/or metering), exhaust gas composition, catalyst temperature, etc.

If it is determined that the intake manifold pressure is not greater than the threshold pressure (NO at 808) the method moves to 810 where the method includes maintaining current operating strategy in the vehicle, engine, evaporative emission control system, etc. After 810 the method proceeds to step 816.

On the other hand, if it is determined that the intake manifold pressure is greater than the threshold pressure (YES at 808) the method proceeds to 812. At 812 the method includes closing the vapor blocking valve. Next at 814 the method includes opening the canister vent valve and at 816 the method includes opening the canister purge valve.

The evaporative emission control system and diagnostic method described herein have the technical effect of providing a reliable diagnostic technique for an evaporative emission control system that may be used in a variety of engine systems. Specifically, the diagnostic technique may be used in evaporative emission control systems having a vapor blocking valve with a breathing component that allows a metered amount of fuel vapor there through when the vapor blocking valve is closed. Additionally, the breathing components provides the technical benefit of reducing fuel tank pressure buildup while flowing a desired amount of fuel vapor to the canister to reduce the likelihood of canister overloading which may cause problems such as stalls, air-fuel disturbances, etc. In this way, the evaporative emission control system can leverage the benefits of a vapor blocking valve with a breathing component while employing a reliable diagnostic routine for the valve.

The invention will be further described in the following paragraphs. In one aspect, a method for diagnosing an evaporative emission control system is provided that includes during a first state of a vapor blocking valve, determining a first rate of change of a vacuum in a fuel tank, during a second state of the vapor blocking valve different from the first state, determining a second rate of change of the fuel tank vacuum, and diagnosing an operational condition of the vapor blocking valve based on the first and second rates of change. In one example, the method may further include generating the vacuum in the fuel tank prior to determining the first rate of change. In another example, the method may further include triggering a vapor blocking valve degradation indicator when the diagnosed operational condition is a degraded condition. In yet another example, the method may further include implementing one or more mitigating actions when the diagnosed operational condition is a degraded condition.

In another aspect, an evaporative emission control system is provided that includes a fuel tank, a fuel vapor canister in selective fluidic communication with the fuel tank, a vapor blocking valve positioned in a vapor line extending between the fuel tank and the fuel vapor canister and including a breathing component allowing a metered amount of fuel vapor to flow there through in a closed configuration, a controller with computer readable instructions stored on non-transitory memory that when executed, cause the controller to, generate a vacuum in the fuel tank, during a first state of the vapor blocking valve, measure a first rate of change of the fuel tank vacuum, during a second state of the vapor blocking valve different from the first state, measure a second rate of change of the fuel tank vacuum, and diagnose an operational condition of the vapor blocking valve based on the first and second rates of change.

In another aspect, a method for diagnosing an evaporative emission control system is provided that includes generating a vacuum in a fuel tank, commanding a vapor blocking valve to close while the fuel tank remains in fluidic communication with a fuel vapor canister through a breathing component in the vapor blocking valve, while the vapor blocking valve is commanded to close, measuring a first rate of change of the vacuum in the fuel tank, commanding the vapor blocking valve to open, while the vapor blocking valve is commanded to open, measuring a second rate of change of the fuel tank vacuum, and diagnosing an operational condition of the vapor blocking valve based on a comparison between the first and second rates of change. In one example, the method may further include triggering a vapor blocking valve degradation indicator and/or implementing one or more mitigating actions when the diagnosed operational condition is a degraded condition.

In any of the aspects or combinations of the aspects, the vapor blocking valve may include a breathing component allowing a metered fuel vapor flow there through in a closed configuration.

In any of the aspects or combinations of the aspects, in the first state the vapor blocking valve may be commanded to close and in the second state the vapor blocking valve may be commanded to open.

In any of the aspects or combinations of the aspects, generating the vacuum in the fuel tank may include closing a canister vent valve and opening a canister purge valve and the vapor blocking valve, and where the canister purge valve may be positioned between a fuel vapor canister and an intake system and the canister vent valve may be positioned in a line coupled to the fuel vapor canister at a first end and opening to an ambient environment at a second end.

In any of the aspects or combinations of the aspects, the steps of determining the first and second rates and change of the fuel tank vacuum may be implemented during a steady state condition.

In any of the aspects or combinations of the aspects, where diagnosing the operational condition of the vapor blocking valve based on the first and second rates of change may include at least one of clipping and normalizing the first and/or second rates of change.

In any of the aspects or combinations of the aspects, the first and second rates of change may be determined using regression analysis.

In any of the aspects or combinations of the aspects, diagnosing the operational condition of the vapor blocking valve based on the first and second rates of change may include determining a ratio between the first and second rates of change.

In any of the aspects or combinations of the aspects, the breathing component in the vapor blocking valve may include a notch in a sealing surface.

In any of the aspects or combinations of the aspects, the breathing component in the vapor blocking valve may include an opening in a valve sealing component.

In any of the aspects or combinations of the aspects, diagnosing the operational condition of the vapor blocking valve may include at least one of clipping and normalizing the first and/or second rates of change.

In any of the aspects or combinations of the aspects, generating the vacuum in the fuel tank may include closing a canister vent valve and opening a canister purge valve and the vapor blocking valve, and where the canister purge valve may be positioned between the fuel vapor canister and an intake system and the canister vent valve may be positioned in a line coupled to the fuel vapor canister at a first end and opening to an ambient environment at a second end.

In any of the aspects or combinations of the aspects, the first and second rates of change may be determined using regression analysis and where diagnosing the operational condition of the vapor blocking valve may include clipping and normalizing the first and/or second rates of change.

In any of the aspects or combinations of the aspects, the evaporative emission control system may be included in a hybrid vehicle including an engine and an electric motor.

In any of the aspects or combinations of the aspects, the one or more mitigating actions includes lowering a purge flow ramp rate during a vapor canister purge event.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An evaporative emission control system comprising:

a fuel tank;

a fuel vapor canister in selective fluidic communication with the fuel tank;

a vapor blocking valve positioned in a vapor line extending between the fuel tank and the fuel vapor canister and including a breathing component allowing a metered amount of fuel vapor to flow there through in a closed configuration;

a controller with computer readable instructions stored on non-transitory memory that when executed, cause the controller to;

generate a vacuum in the fuel tank;

during a first state of the vapor blocking valve, measure a first rate of change of the fuel tank vacuum;

during a second state of the vapor blocking valve different from the first state, measure a second rate of change of the fuel tank vacuum; and diagnose an operational condition of the vapor blocking valve based on the first and second rates of change.

2. The evaporative emission control system of claim 1, where the breathing component in the vapor blocking valve includes a notch in a sealing surface.

3. The evaporative emission control system of claim 1, where the breathing component in the vapor blocking valve includes an opening in a valve sealing component.

4. The evaporative emission control system of claim 1, where diagnosing the operational condition of the vapor blocking valve includes at least one of clipping and normalizing the first and/or second rates of change.

5. The evaporative emission control system of claim 1, where generating the vacuum in the fuel tank includes closing a canister vent valve and opening a canister purge valve and the vapor blocking valve, and where the canister purge valve is positioned between the fuel vapor canister and an intake system and the canister vent valve is positioned in a line coupled to the fuel vapor canister at a first end and opening to an ambient environment at a second end.

6. A method for diagnosing an evaporative emission control system, comprising:

during a first state of a vapor blocking valve, determining a first rate of change of a fuel tank vacuum;

during a second state of the vapor blocking valve different from the first state, determining a second rate of change of the fuel tank vacuum; and diagnosing an operational condition of the vapor blocking valve based on the first and second rates of change.

7. The method of claim 6, where the vapor blocking valve includes a breathing component allowing a metered fuel vapor flow there through in a closed configuration.

8. The method of claim 6, where in the first state the vapor blocking valve is commanded to close and in the second state the vapor blocking valve is commanded to open.

9. The method of claim 6, further comprising generating the vacuum in the fuel tank prior to determining the first rate of change.

10. The method of claim 9, where generating the vacuum in the fuel tank includes closing a canister vent valve and opening a canister purge valve and the vapor blocking valve, and where the canister purge valve is positioned between a fuel vapor canister and an intake system and the canister vent valve is positioned in a line coupled to the fuel vapor canister at a first end and opening to an ambient environment at a second end.

11. The method of claim 6, further comprising triggering a vapor blocking valve degradation indicator when the diagnosed operational condition is a degraded condition.

12. The method of claim 6, further comprising implementing one or more mitigating actions when the diagnosed operational condition is a degraded condition.

13. The method of claim 12, where the one or more mitigating actions includes lowering a purge flow ramp rate during a vapor canister purge event.

14. The method of claim 6, where the steps of determining the first and second rates and change of the fuel tank vacuum are implemented during a steady state condition.

15. The method of claim 6, where diagnosing the operational condition of the vapor blocking valve based on the first and second rates of change includes at least one of clipping and normalizing the first and/or second rates of change.

16. The method of claim 6, where the first and second rates of change are determined using regression analysis.

17. The method of claim 6, where diagnosing the operational condition of the vapor blocking valve based on the first and second rates of change includes determining a ratio between the first and second rates of change.

18. A method for diagnosing an evaporative emission control system, comprising:

generating a vacuum in a fuel tank;

commanding a vapor blocking valve to close while the fuel tank remains in fluidic communication with a fuel vapor canister through a breathing component in the vapor blocking valve;

while the vapor blocking valve is commanded to close, measuring a first rate of change of the vacuum in the fuel tank;

commanding the vapor blocking valve to open;

while the vapor blocking valve is commanded to open, measuring a second rate of change of the vacuum in the fuel tank; and diagnosing an operational condition of the vapor blocking valve based on a comparison between the first and second rates of change.

19. The method of claim 18, where the first and second rates of change are determined using regression analysis and where diagnosing the operational condition of the vapor blocking valve includes clipping and normalizing the first and/or second rates of change.

20. The method of claim 18, further comprising triggering a vapor blocking valve degradation indicator and/or implementing one or more mitigating actions when the diagnosed operational condition is a degraded condition.

* * * * *